United States Patent [19]

Hartmann

[11] Patent Number: 4,707,112

[45] Date of Patent: Nov. 17, 1987

[54] LIQUID DEVELOPMENT SYSTEM

[75] Inventor: George C. Hartmann, Fairport, N.Y.

[73] Assignee: Xerox Corporation, Stamford, Conn.

[21] Appl. No.: 864,044

[22] Filed: May 16, 1986

[51] Int. Cl.[4] ..... G03G 15/10

[52] U.S. Cl. ..... 355/10; 355/3 R; 355/14 D; 430/117

[58] Field of Search ..... 355/10, 3 R, 300, 14 D, 355/14 R; 430/119, 117, 118; 118/650

[56] References Cited

U.S. PATENT DOCUMENTS

| | | | |
|---|---|---|---|
| 3,576,623 | 4/1971 | Snelling | 96/1 |
| 3,965,861 | 6/1976 | Fukushima et al. | 118/637 |
| 3,981,576 | 9/1976 | Inoue | 355/10 X |
| 4,021,586 | 5/1977 | Matkan | 355/10 X |
| 4,073,266 | 2/1978 | Arneth et al. | 118/647 |
| 4,077,712 | 3/1978 | Imarzumi et al. | 355/10 |
| 4,139,299 | 2/1979 | Miyakawa et al. | 355/10 |
| 4,176,942 | 12/1979 | Tatsumi et al. | 355/10 X |
| 4,264,185 | 4/1981 | Ohta | 355/10 X |
| 4,319,544 | 3/1982 | Weber | 355/10 X |
| 4,493,550 | 1/1985 | Takekida | 355/10 |

*Primary Examiner*—A. C. Prescott

*Attorney, Agent, or Firm*—H. Fleischer; J. E. Beck; R. Zibelli

[57] ABSTRACT

An electrophotographic printing machine in which an electrostatic latent image recorded on a photoconductive surface is developed with a liquid developer material comprising at least a liquid carrier having marking particles therein. The liquid developer material is furnished to the electrostatic latent image recorded on the photoconductive surface in a development zone to develop the latent image. Marking particles are substantially uniformly dispersed in the liquid carrier of the liquid developer material at the entrance to the development zone so as deflocculate the marking particles.

12 Claims, 2 Drawing Figures

LIQUID DEVELOPMENT SYSTEM

Figure 1:
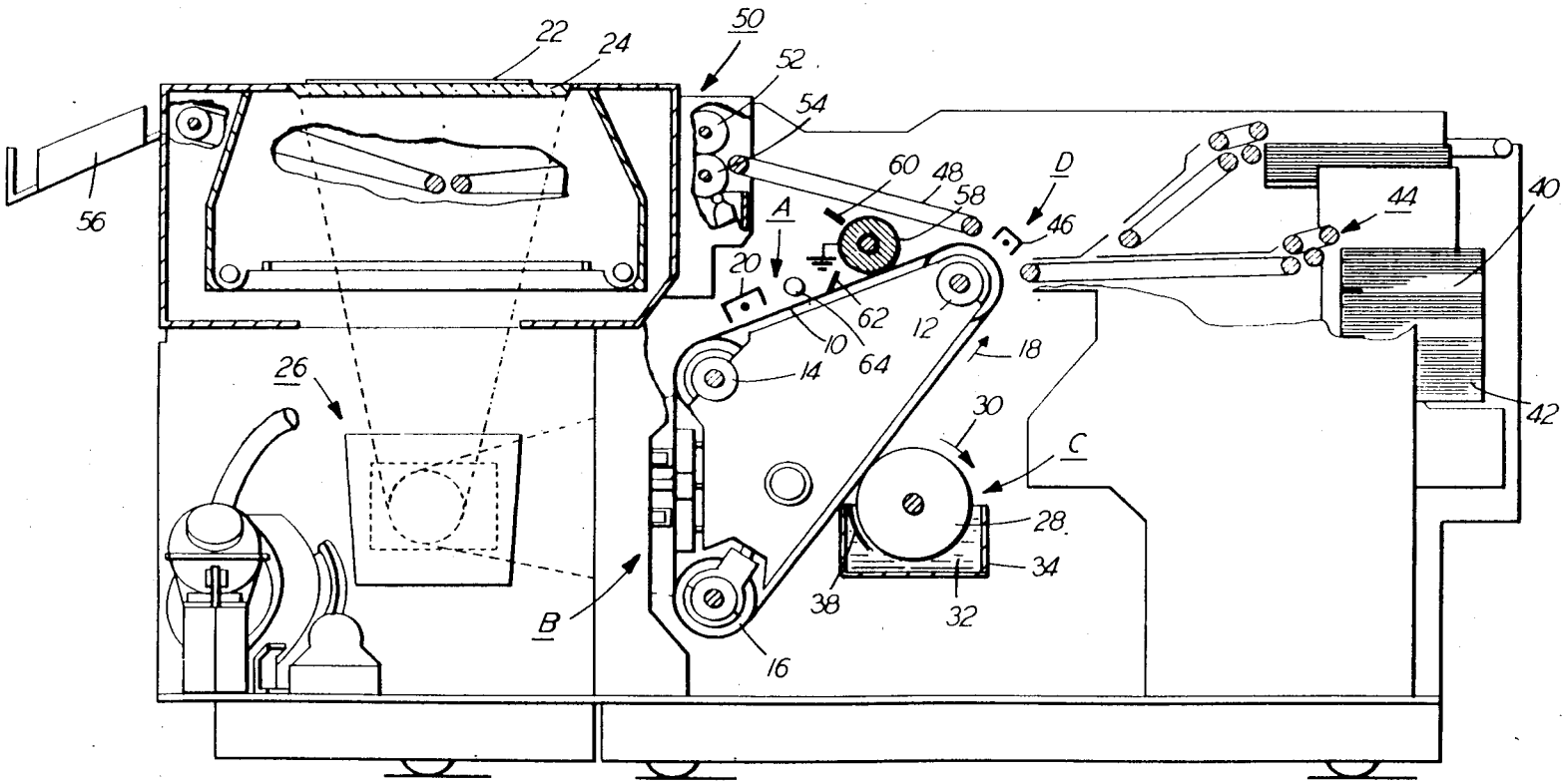

This invention relates generally to an electrophotographic printing machine, and more particularly concerns an apparatus for developing an electrostatic latent image recorded on a photoconductive surface with a liquid developer material comprising a liquid carrier having marking particles dispersed therein.

A typical electrophotographic printing machine employs a photoconductive member that is charged to a substantially uniform potential so as to sensitize the surface thereof. The charged portion of the photoconductive member is exposed to a light image of an original document being reproduced. Exposure of the charged photoconductive member selectively dissipates the charge, in the irradiated areas, to record an electrostatic latent image on the photoconductive member corresponding to the informational areas contained within the original document. After the electrostatic latent image is recorded on the photoconductive member, the latent image is developed by bringing a developer material into contact therewith. A dry developer material comprising carrier granules having toner particles adhering thereto is brought into contact with the latent image. The latent image attracts the toner particles from the carrier granules to form a toner powder image on the photoconductive surface. The toner powder image is then transferred to the copy sheet and, thereafter, permanently fused thereto.

Development of an electrostatic latent image may also be achieved with a liquid developer material rather than a dry developer material. In a liquid development system, an insulating liquid carrier having finely divided marking particles dispersed therein contacts the photoconductive surface. Under the influence of the electrical field associated with the electrostatic latent image, the marking particles are attracted to the photoconductive surface to form a visible image. It has been found that when a liquid developer material is employed, the midtone solid areas of the developed image frequently exhibit a mottled appearance. It is believed that one of the underlying mechanisms causing the mottled appearance in the mid-tone solid area is due to flocculation, i.e. the formation of agglomerates, of marking particles in the liquid carrier. Thus, if the agglomerates of marking particles in the liquid carrier are broken up, i.e., deflocculated, a significant improvement in solid area development occurs. Various types of development systems have been employed with liquid development materials. The following disclosures appear to be relevant:

U.S. Pat. No. 3,576,623
Patentee: Snelling
Issued: Apr. 27, 1971
U.S. Pat. No. 3,965,861
Patentee: Fukushima et al.
Issued: June 29, 1976
U.S. Pat. No. 4,073,266
Patentee: Arneth et al.
Issued: Feb. 14, 1978
U.S. Pat. No. 4,077,712
Patentee: Imaizumi et al.
Issued: Mar. 7, 1978

The relevant portions of the foregoing patent may be briefly summarized as follows:

Snelling describes a development system employing a coronode immersed in a liquid developer. The coronode is positioned in the development zone to control development.

Fukushima et al. discloses a development roll which serves as a developing electrode and transports a liquid developer material into contact with the electrostatic latent image recorded on an image bearing material. A member is interposed between a pair of developed rollers and furnishes developer material which runs over the sides thereof between adjacent developer rollers. The developer material is supplied onto the image bearing surface in a laminar pattern. The Reynolds Number is maintained below 2000 to maintain laminar flow and avoid turbulence.

Arneth et al. describes an apparatus for developing an electrostatic latent image recorded on a copying material. A voltage having the same polarity as the surface charge of the electrostatic latent image is applied to a distribution roller to eliminate thin white lines on the image.

Imaizumi et al. discloses a developing device employing a liquid developing solution for use in an electrophotographic printing machine. A plurality of electrode rollers are immersed in the developing solution to provide efficient circulation of the developing solution and rapid and uniform dispersion of toner particles in the developing solution.

In accordance with one aspect of the features of the present invention, there is provided an apparatus for developing an electrostatic latent image with a liquid developer material comprising at least a liquid carrier having marking particles dispersed therein. Means are provided for furnishing the liquid developer material to the electrostatic latent image in a development zone to develop the electrostatic latent image. Means disperse the marking particles substantially uniformly in the liquid carrier at the entrance to the development zone so as to deflocculate the marking particles therein.

Pursuant to another aspect of the features of the present invention, there is provided an electrophotographic printing machine of the type having an electrostatic latent image recorded on a photoconductive surface developed with a liquid developer material comprising at least a liquid carrier having marking particles dispersed therein. Means are provided for furnishing the liquid developer material to the electrostatic latent image recorded on the photoconductive surface in a development zone to develop the electrostatic latent image. Means disperse the marking particles substantially uniformly in the liquid carrier at the entrance to the development zone so as to deflocculate the marking particles therein.

Figure 2:
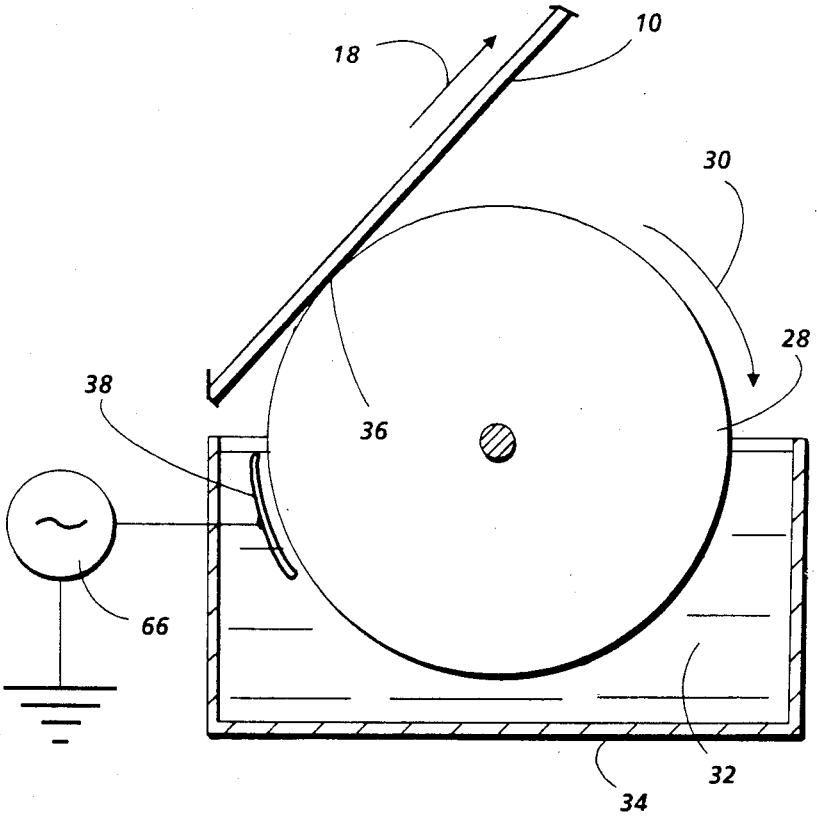

Other aspects of the present invention will become apparent as the following description proceeds and upon reference to the drawings, in which:

FIG. 1 is a schematic elevational view depicting an electrophotographic printing machine incorporating the features of the present invention therein; and FIG. 2 is an elevational view showing the development apparatus used in the FIG. 1 printing machine.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements. FIG. 1 is a schematic elevational view illustrating an electrophotographic printing machine incorporating the features of the present invention therein. It is will become apparent from the following discussion that the apparatus of the present invention is equally well suited for use in a wide variety of printing machines and is not necessarily limited in its application to the particular embodiment shown herein.

Turning now to FIG. 1, the printing machine employs a belt 10 having a photoconductive surface deposited on a conductive substrate. Preferably, the photoconductive surface is made from a selenium alloy with the conductive substrate being preferably made from an aluminum alloy which is electrically grounded. Belt 10 advances successive portions of the photoconductive surface sequentially through the various processing stations disposed about the path of movement thereof. The support assembly for belt 10 includes three rollers 12, 14 and 16 located with parallel axes approximately at the apexes of a triangle. Roller 12 is rotatably driven by a suitable motor and drive (not shown) so as to rotate and advance belt 10 in the direction of arrow 18.

Initially, belt 10 passes through charging station A. At charging station A, a corona generating device 20 charges the photoconductive surface of belt 10 to a relatively high, substantially uniform potential.

After the photoconductive surface of belt 10 is charged, the charged portion thereof is advanced to exposure station B. At exposure station B, an original document 22 is placed upon a transparent support platen 24. An illumination assembly, indicated generally by the reference numeral 26, illuminates the original document 22 on platen 24 to produced image rays corresponding to the informational areas of the original document. The image rays are projected by means of an optical system onto the charged portion of the photoconductive surface. The light image dissipates the charge in selected areas to record an electrostatic latent image on the photoconductive surface which corresponds to the informational areas contained within original document 22.

After the electrostatic latent image has been recorded on the photoconductive surface of belt 10, belt 10 advances the electrostatic latent image to development station C. At development station C, a roller 28, rotating in the direction of arrow 30, advances a liquid developer material 32 comprising marking particles, i.e. toner particles, in a insulating liquid carrier from the chamber of housing 34 to development zone 36. An electrode 38 positioned before the entrance to development zone 36 is electrically biased to generate an AC field just prior to the entrance to development zone 36 so as to disperse the marking particles substantially uniformly throughout the liquid carrier in this region. This causes deflocculation of the marking particles.in the liquid carrier. The detailed arrangement of development station C will be described hereinafter with reference to FIG. 2. The marking particles, disseminated through the liquid carrier, pass by electrophoresis to the electrostatic latent image. The charge of the marking particles is opposite in polarity to the charge on the photoconductive surface. For example, if the photoconductive surface is made from a selenium alloy, the corona charge will be positive and the toner particles will be negatively charged. Alternatively, if the photoconductive surface is made from a cadmium sulphide material, the charge will be negative and the toner particle will have a positive charge. A suitable developer material is described in U.S. Pat. No. 4,582,774 issued to Landa in 1986, the relative portions thereof being hereby incorporated into the present application. By way of example, the insulating carrier liquid may be a hydrocarbon liquid although other insulating liquids may also be employed. A suitable hydrocarbon liquid is an Isopar which is a trademark of the Exxon Corporation. These are branched, chained aliphatic hydrocarbon liquids (largely decane). The toner particles comprise a binder and a pigment. The pigment may be carbon black. However, one skilled in the art will appreciate that any suitable liquid development material may be employed.

After the electrostatic latent image is developed, belt 10 advances the developed image to transfer station D. At transfer station D, a sheet of support material 40 is advanced from stack 42 by a sheet transport mechanism, indicated generally by the reference numeral 44. Transfer station D includes a corona generating device 46 which sprays ions onto the backside of the sheet of support material 40. This attracts the developed image from the photoconductive surface of belt 10 to copy sheet 40. After transfer, conveyor belt 48 moves the copy sheet to fusing station E.

Fusing station E includes a fuser assembly, indicated generally by the reference numeral 50, which permanently fuses the developed image to the copy sheet. Fuser assembly 50 includes a heated fuser roll 42 and back-up or pressure roll 54 resiliently urged into engagement therewith to form a nip through which the copy sheet passes. After fusing, the finished copy sheet is discharged to output tray 6 for removal therefrom by the machine operator.

With continued reference to FIG. 1, after a developed image is transferred to the copy sheet, residual liquid developer material remains adhering to the photoconductive surface of belt 10. A cleaning roller 58 formed of any appropriate synthetic resin, is driven in a direction opposite to the direction of movement of belt 10 to scrub the photoconductive surface clean. To assist in this action, developing liquid may be fed through pipe 60 to the surface of cleaning roller 8. A wiper blade 62 completes the cleaning of the photoconductive surface. Any residual charge left on the photoconductive surface is extinguished by flooding the photoconductive surface with light from lamps 64.

Referring now to FIG. 2, there is shown the detailed structure of development station C. As shown thereat, development station C includes a developer roller 28 rotating in the direction of arrow 30 so as to pass through developer material 32 located in the chamber of housing 34. Developer roller 28 transports developer material into development zone 36 so that the electrostatic latent image recorded on the photoconductive surface of belt 10 attracts the marking particles thereto to form a visible image thereon. Developer roller 28 may either contact or be slightly apart from the photoconductive surface. Developer roller 28 is driven in the direction of arrow 30 by a suitable driving device which is not illustrated. Roller 28 is conductive, being made from metal or any other appropriate material and serves as a developing electrode. Thus, roller 28 is electrically biased to a suitable potential and magnitude. Development electrode 38 is located before the entrance to development zone 36 and spaced from developer roller 28. Electrode 38 generates a pulsed electrical field so as to move the marking particles in the liquid carrier by electrophoresis to substantially uniformly disperse the marking particles in the liquid carrier prior to entering development zone 36. This is achieved by electrically biasing electrode 38 with a pulsed generator, i.e. any suitable pulse may be employed. However, it is preferable to utilize an AC generator. Thus, an alternating electrical field is generated which moves the marking particles in the liquid carrier to substantially uniformly disperse the marking particles in the liquid carrier, thereby deflocculating the marking particles in the liquid developer material just prior to entering development zone 36. Electrode 38 is electrically biased by an alternately current voltage source 66 connected thereto.

One skilled in the art will appreciate that any suitable technique to create motion of the marking particles in the liquid carrier may be employed. For example, an acoustic generator may be used to transmit sound waves through the liquid developer material in the region prior to the entrance to development zone 36. The frequency of these sound waves is such that the liquid developer material is agitated and becomes turbulent. Still another approach is to employ mechanical means such as a stirrer or mixing device which agitates and mixes the liquid developer material just prior to the entrance to the development zone so as to once again create turbulence therein. In any case, any suitable technique may be utilized so long as the marking particles are induced to disperse substantially uniformly in the liquid carrier. In this manner, the agglomerates of marking particles are broken up, or deflocculated.

Deflocculation is achieved by dispersing the marking particles substantially uniformly throughout the liquid carrier by the use of either an AC electrical field, which causes marking particle motion through the liquid carrier by electrophoresis, or by mixing the liquid developer material, which can be caused by mechanical or acoustical devices. Accordingly, marking particle deflocculation can be achieved by mixing the liquid developer material, i.e. causing turbulence therein, or by moving the marking particles through the liquid carrier by electrophoresis. Generally, The charge of each marking particle and the Stoke's radius of each marking particle are different so that each marking particle migrates a different distance when the electrical field is applied thereon resulting in deflocculation of the marking particles in the liquid carrier.

In recapitulation, it has been found that by inducing dispersion of the marking particles in the liquid developer material just prior to entering the development zone, deflocculation occurs. When the agglomerates of marking particles are broken up and substantially uniformly dispersed throughout the liquid carrier, mottling is significantly reduced in the resultant copy. Substantially uniform dispersion of the marking particles in the liquid carrier of the developer material may be induced by electrical, acoustical or mechanical devices. It is, thus, clear that the development system of the present invention minimizes the formation of mottled regions in solid areas of the copy by deflocculating the marking particles just prior to entrance into the development zone resulting in significantly improved copy quality.

It is, therefore, apparent that there has been provided, in accordance with the present invention, an apparatus for developing an electrostatic latent image with a liquid developer material. This apparatus fully satisfies the aims and advantages hereinbefore set forth. While this invention has been described in conjunction with a specific embodiment thereof, it is is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for developing an electrostatic latent image with a liquid developer material comprising at least a liquid carrier having marking particles therein, including:

means for furnishing the liquid developer material to the electrostatic latent image in a development zone to develop the electrostatic latent image; and means for dispersing the marking particles substantially uniformly in the liquid carrier of the liquid developer material at the entrance to the development zone so as to deflocculate the marking particles.

2. An apparatus for developing an electrostatic latent image with a liquid developer material comprising at least a liquid carrier having marking particles therein, including:

means for furnishing the liquid developer material to the electrostatic latent image in a development zone to develop the electrostatic latent image; and means for dispersing the marking particles substantially uniformly in the liquid carrier of the liquid developer material at the entrance to the development zone so as to deflocculate the marking particles, said dispersing means comprises means for generating a pulsed electrical field in the developer material at the entrance to the development zone to induce movement of the marking particles in the liquid carrier of the liquid developer material.

3. An apparatus according to claim 2, wherein said generating means includes;

an electrode positioned at the entrance to the development zone; and means for applying a pulsed voltage to said electrode to generate an pulsed electrical field in the developer material at the entrance to the development zone.

4. An apparatus according to claim 3, wherein said applying means generates an alternating voltage.

5. An apparatus according to claim 1, wherein said dispersing means includes means for mechanically mixing the developer material at the entrance to the development zone.

6. An apparatus for developing an electrostatic latent image with a liquid developer material comprising at least a liquid carrier having marking particles therein, including:

means for furnishing the liquid developer material to the electrostatic latent image in a development zone to develop the electrostatic latent image; and means for dispersing the marking particles substantially uniformly in the liquid carrier of the liquid developer material at the entrance to the development zone so as to deflocculate the marking particles, said dispersing means comprises means for acoustically vibrating the developer material at the entrance to the development zone.

7. An electrophotographic printing machine of the type having an electrostatic latent image recorded on a photoconductive surface developed with a liquid developer material comprising at least a liquid carrier having marking particles therein, wherein the improvement includes:

means for furnishing the liquid developer material to the electrostatic latent image recorded on the photoconductive surface in a development zone to develop the electrostatic latent image; and means for dispersing the marking particles substantially uniformly in the liquid carrier of the liquid developer material at the entrance to the development zone so as to deflocculate the marking particles.

8. An electrophotographic printing machine of the type having an electrostatic latent image recorded on a photoconductive surface developed with a liquid developer material comprising at least a liquid carrier having marking particles therein, wherein the improvement includes:

means for furnishing the liquid developer material to the electrostatic latent image recorded on the photoconductive surface in a development zone to develop the electrostatic latent image; and means for dispersing the marking particles substantially uniformly in the liquid carrier of the liquid developer material at the entrance to the development zone so as to deflocculate the marking particles, said dispersing means comprises means for generating a pulsed electrical field in the developer material at the entrance to the development zone.

9. A printing machine according to claim 8, wherein said generating means includes;

an electrode positioned at the entrance to the development zone; and means for applying a pulsed voltage to said electrode to generate a pulsed electrical field in the developer material at the entrance to the development zone.

10. A printing machine according to claim 9, wherein said applying means generates an alternating voltage.

11. A printing machine according to claim 7, wherein said dispersing means includes means for mechanically mixing the developer material at the entrance to the development zone.

12. An electrophotographic printing machine of the type having an electrostatic latent image recorded on a photoconductive surface developed with a liquid developer material comprising at least a liquid carrier having marking particles therein, wherein the improvement includes:

means for furnishing the liquid developer material to the electrostatic latent image recorded on the photoconductive surface in a development zone to develop the electrostatic latent image; and means for dispersing the marking particles substantially uniformly in the liquid carrier of the liquid developer material at the entrance to the development zone so as to deflocculate the marking particles, said dispersing means comprises means for acoustically vibrating the developer material at the entrance to the development zone.

* * * * *